US008365676B1

(12) United States Patent
McAuliff

(10) Patent No.: US 8,365,676 B1
(45) Date of Patent: Feb. 5, 2013

(54) WALL-MOUNTED STAND FOR A HOTEL ROOM

(76) Inventor: James F. McAuliff, Hatfield, PA (US)

( * ) Notice: Subject to any disclaimer, the term of this patent is extended or adjusted under 35 U.S.C. 154(b) by 70 days.

(21) Appl. No.: 12/940,015

(22) Filed: Nov. 4, 2010

Related U.S. Application Data

(60) Provisional application No. 61/259,110, filed on Nov. 6, 2009.

(51) Int. Cl.
*A47B 5/00* (2006.01)

(52) U.S. Cl. ..... 108/48

(58) Field of Classification Search ..... 108/134, 108/42, 44, 48; 248/240, 240.1, 240.4; 297/13, 297/14, 331, 332, 334
See application file for complete search history.

(56) References Cited

U.S. PATENT DOCUMENTS

| | | | | | |
|---|---|---|---|---|---|
| 601,118 | A * | 3/1898 | Beatty | 248/240.2 |
| 1,133,611 | A * | 3/1915 | Borgmeyer | 211/12 |
| 1,210,095 | A * | 12/1916 | Noack | 108/33 |
| 1,783,660 | A * | 12/1930 | Maes | 248/240.1 |
| 1,834,792 | A * | 12/1931 | Mastrangelo et al. | 248/240.2 |
| 2,046,398 | A * | 7/1936 | McGowan | 297/147 |
| 2,574,302 | A | 11/1951 | Turner | |
| 2,633,179 | A * | 3/1953 | Smith | 248/240.1 |
| 3,136,386 | A * | 6/1964 | Jung et al. | 182/77 |
| 4,087,127 | A * | 5/1978 | Lotta | 297/14 |
| 4,155,609 | A * | 5/1979 | Skafte et al. | 312/245 |
| 4,201,359 | A * | 5/1980 | Baslow | 248/345.1 |
| 4,803,930 | A * | 2/1989 | Crocoli | 108/48 |
| 5,094,515 | A * | 3/1992 | Low | 312/235.1 |
| 5,819,670 | A * | 10/1998 | O'Connor et al. | 108/48 |
| 6,113,202 | A * | 9/2000 | Germano | 312/245 |
| 6,182,724 | B1 * | 2/2001 | Chou et al. | 144/286.5 |
| 6,606,806 | B2 * | 8/2003 | Butters et al. | 38/137 |
| 6,786,162 | B1 * | 9/2004 | Volkmer et al. | 108/115 |
| 7,350,549 | B2 * | 4/2008 | Carter | 144/285 |

* cited by examiner

*Primary Examiner* — Jose V Chen
*Assistant Examiner* — Matthew Ing
(74) *Attorney, Agent, or Firm* — LaMorte & Associates, P.C.

(57) ABSTRACT

A wall mounted luggage stand assembly for supporting a piece of luggage in a hotel room. The luggage stand assembly has a backboard that is mounted to a wall. A shelf is provided that has a bottom surface and a rear edge. The shelf is connected to the backboard with a hinged connection proximate that enables the shelf to rotate between a vertical orientation and a horizontal orientation. At least one damper piston is provided that retards the movement of the shelf from its vertical orientation to its horizontal orientation. A vertical support panel is connected to the bottom surface of the shelf. The vertical support panel rotates with gravity to always remain in a vertical orientation. The vertical support panel contacts the floor when the shelf rotates to its open horizontal position, therein supporting the shelf.

16 Claims, 5 Drawing Sheets

WALL-MOUNTED STAND FOR A HOTEL ROOM

RELATED APPLICATIONS

This application is a continuation-in-part of U.S. Provisional Patent Application No. 61/259,110, filed Nov. 6, 2009 and entitled Wall-Mounted Luggage Stand for a Hotel Room.

BACKGROUND OF THE INVENTION

1. Field of the Invention

In general, the present invention relates to luggage stands and similar structures that are designed to hold a suitcase while it is being packed or unpacked.

2. Description of the Prior Art

When people travel and stay in a hotel or similar establishment, they typically bring luggage. The luggage is used to hold the clothes and other personal belongings of the person staying in the room. Many hotels provide each room with at least one luggage stand. The luggage stand is typically a portable piece of folding furniture that can be used to hold a suitcase, trunk, or other piece of luggage at a convenient height.

Most hotels have management that prefer that their customers use the luggage stand provided in a hotel room. If a customer places their luggage on the luggage stand, then that customer will not likely place their luggage on the beds, chairs, table, or other furniture. In this manner, the furniture will not become soiled and/or scratched. Likewise, if the traveler has bedbugs or other pests in his/her luggage, those pests are less likely to be transferred to the beds and furniture.

Similarly, travelers tend to like luggage stands for the same reason. By using a luggage stand, travelers can have a measure of protection to ensure that any bedbugs or other pests that may be in the bed or furniture of a hotel room will not infest their luggage.

Despite the advantages, luggage stands are not always used. The reason that luggage stands are not used more often is simply an issue of room presentation. Luggage stands tend to be bulky and unsightly. The presence of the luggage rack also makes it difficult for a room maid to properly vacuum and clean a room. Accordingly, when a hotel prepares a room for a new traveler, they typically do not leave the luggage stand out in an open position. Rather, the luggage stand is folded into its closed position and is typically stored in the closet or in a corner of the room. Once a traveler enters a room, they may not immediately see the luggage stand. Furthermore, a traveler does not immediately know where the luggage rack is or even if there is a luggage stand. As a result, a traveler often places his/her luggage on the bed or another piece of furniture primarily out of convenience. Once placed in such a position, a traveler is likely not to move his/her luggage to the luggage stand even if the luggage stand is later located.

As is later described in detail, the present invention provides a folding luggage stand that is mounted to the wall of a hotel room. This enables it to be folded up out of the way without being removed from a convenient location. In the prior art, there have been many folding chairs, tables and even beds that have been designed to be folded up into a wall mount. Such prior art devices are exemplified by U.S. Pat. No. 2,574,302 to Turner, entitled Folding Wall Seat. Although many of these prior art devices can be adapted for use as a luggage stand, it is unlikely that any such prior art device will be used in a modern hotel room. One reason is that such prior art devices are mounted in the wall and require that a large depression be cut out of the wall. Modern hotels line room walls with sound insulating materials to prevent sound from traveling between rooms. Hotels want this sound insulation to remain uninterrupted. Furthermore, hotels do not want openings in the walls that may harbor pests. Another reason why such prior art devices are not used is one of room damage control. People travel with luggage that can weigh well over one-hundred pounds. Travelers lift these bags and drop them onto luggage stands. Consequently, luggage stands become damaged quite frequently. A damaged luggage stands is easy to replace in a room. However, if a wall mounted stand becomes damaged, the hotel room is out of service until the unit can be repaired.

A need therefore exists for a baggage stand that folds up against a wall without requiring a depression be formed within the wall. A need also exists for a luggage stand of great strength and durability so that it can safely hold the heaviest of luggage. These needs are met by the present invention as described and claimed below.

SUMMARY OF THE INVENTION

The present invention is a wall mounted luggage stand assembly for supporting a piece of luggage in a hotel room. The luggage stand assembly has a backboard that is mounted to a wall. A shelf is provided that has a bottom surface and a rear edge. The shelf is connected to the backboard with a hinged connection proximate its rear edge. This enables the shelf to rotate between a vertical orientation, where said shelf is generally parallel to the backboard, and a horizontal orientation, where the shelf is generally perpendicular to the backboard.

At least one damper piston is provided that has a first end coupled to the backboard and a second end coupled to the bottom surface of the shelf. The damper piston retards the movement of the shelf from its closed vertical orientation to its open horizontal orientation.

A vertical support panel is connected to the bottom surface of the shelf. The vertical support panel rotates at the connection with gravity to always remain in a vertical orientation. The vertical support panel contacts the floor when the shelf rotates to its open horizontal position, therein supporting the shelf.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention can be embodied in many ways, the embodiment being illustrated is only for a single luggage stand assembly. This embodiment is selected in order to set forth the best mode contemplated for the invention. The illustrated embodiment, however, is merely exemplary and should not be considered a limitation when interpreting the scope of the appended claims.

Figure 1:
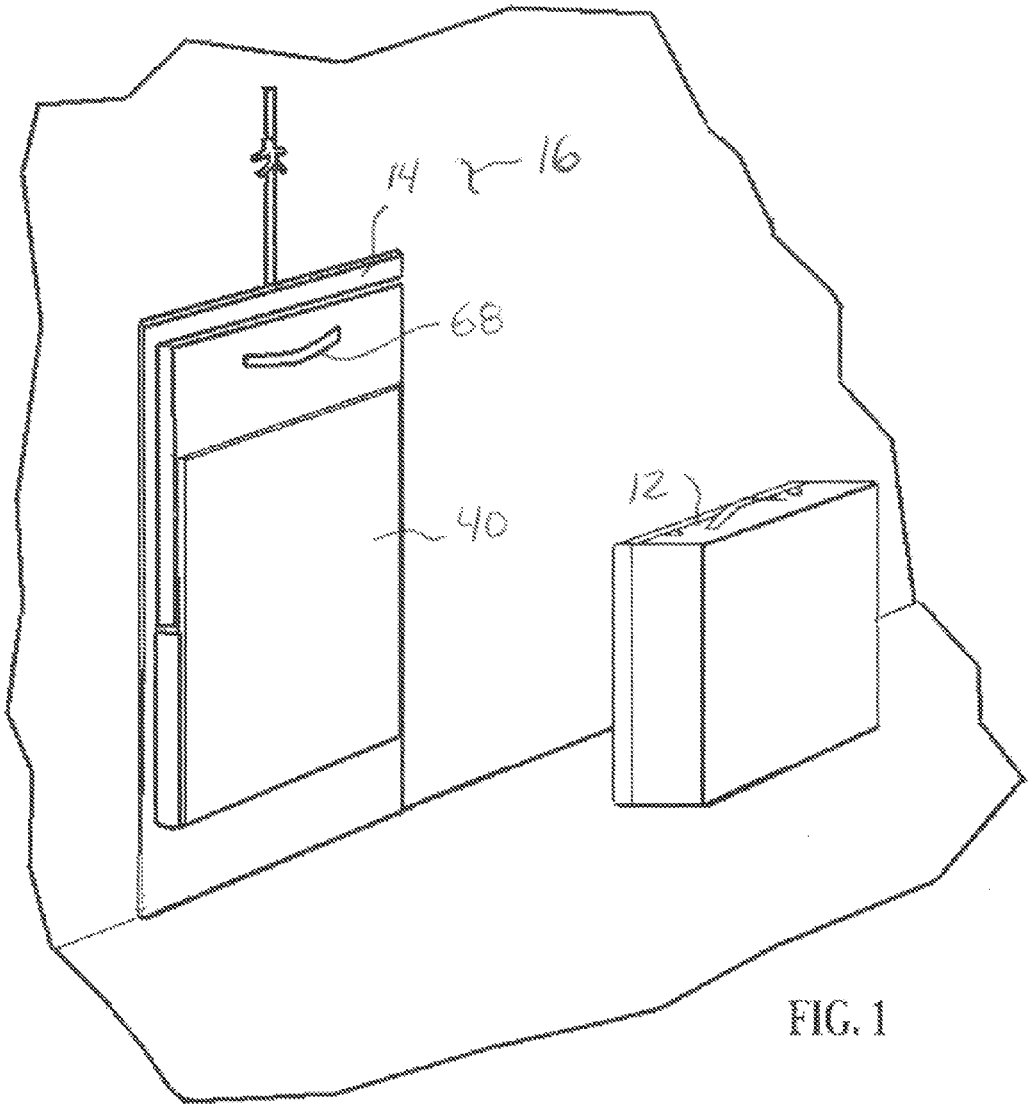
FIG. 1 is a perspective view of an exemplary embodiment of a luggage stand shown in its closed configuration.
Figure 2:
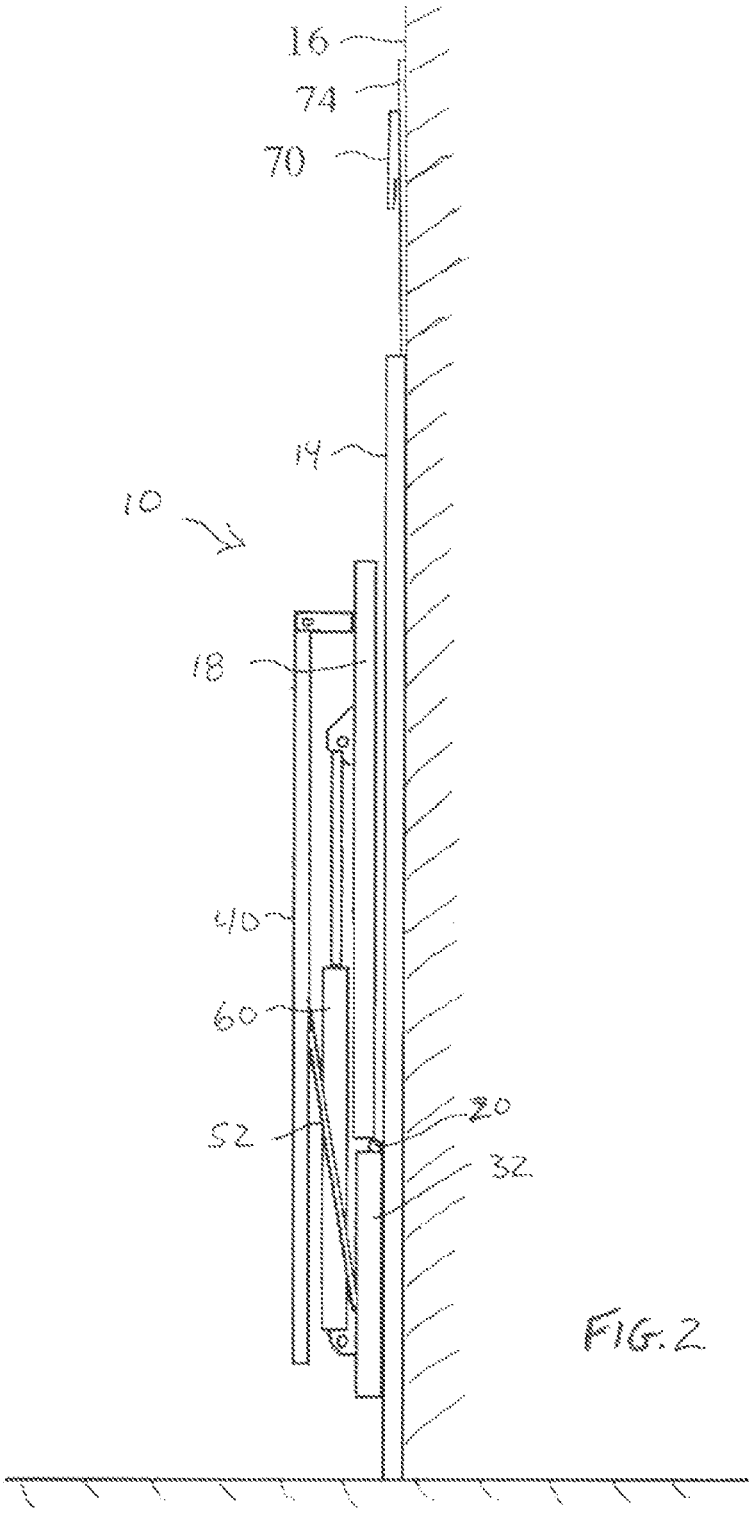
FIG. 2 is a cross-sectional view of the embodiment of FIG. 1.
Figure 3:
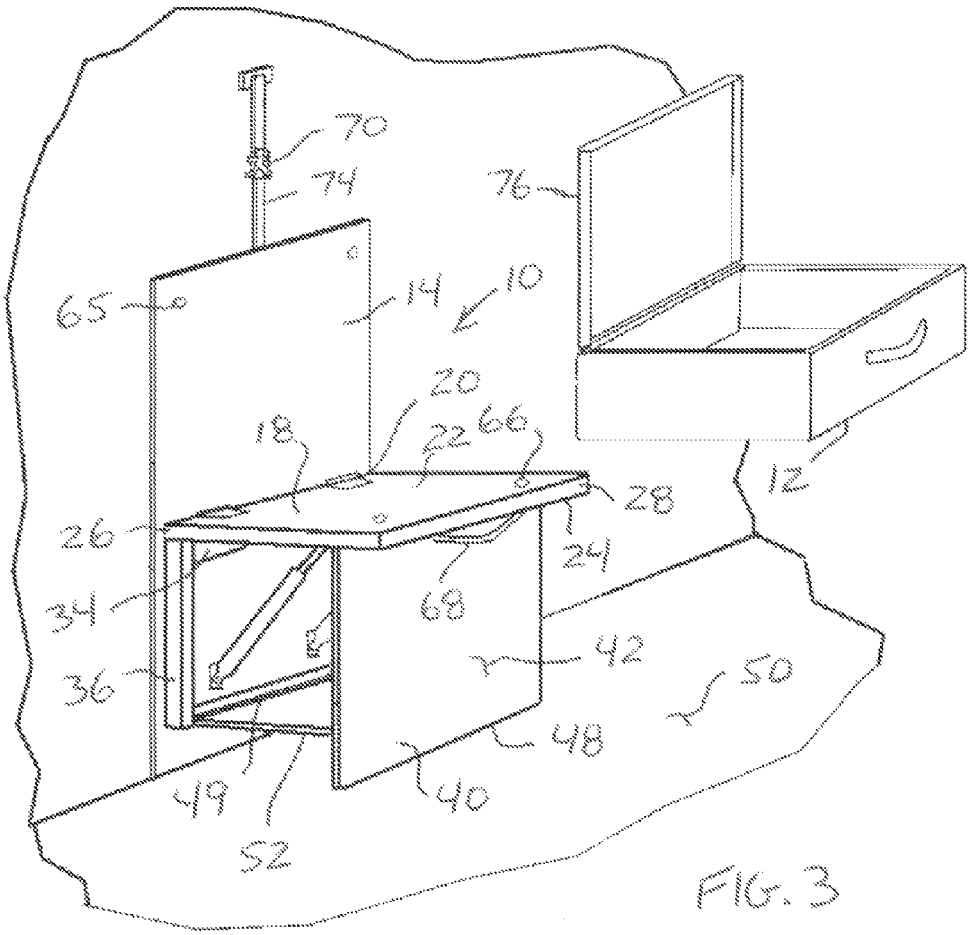
FIG. 3 is a perspective view of an exemplary embodiment of a luggage stand shown in its open configuration and shown in conjunction with a suitcase.
Figure 4:
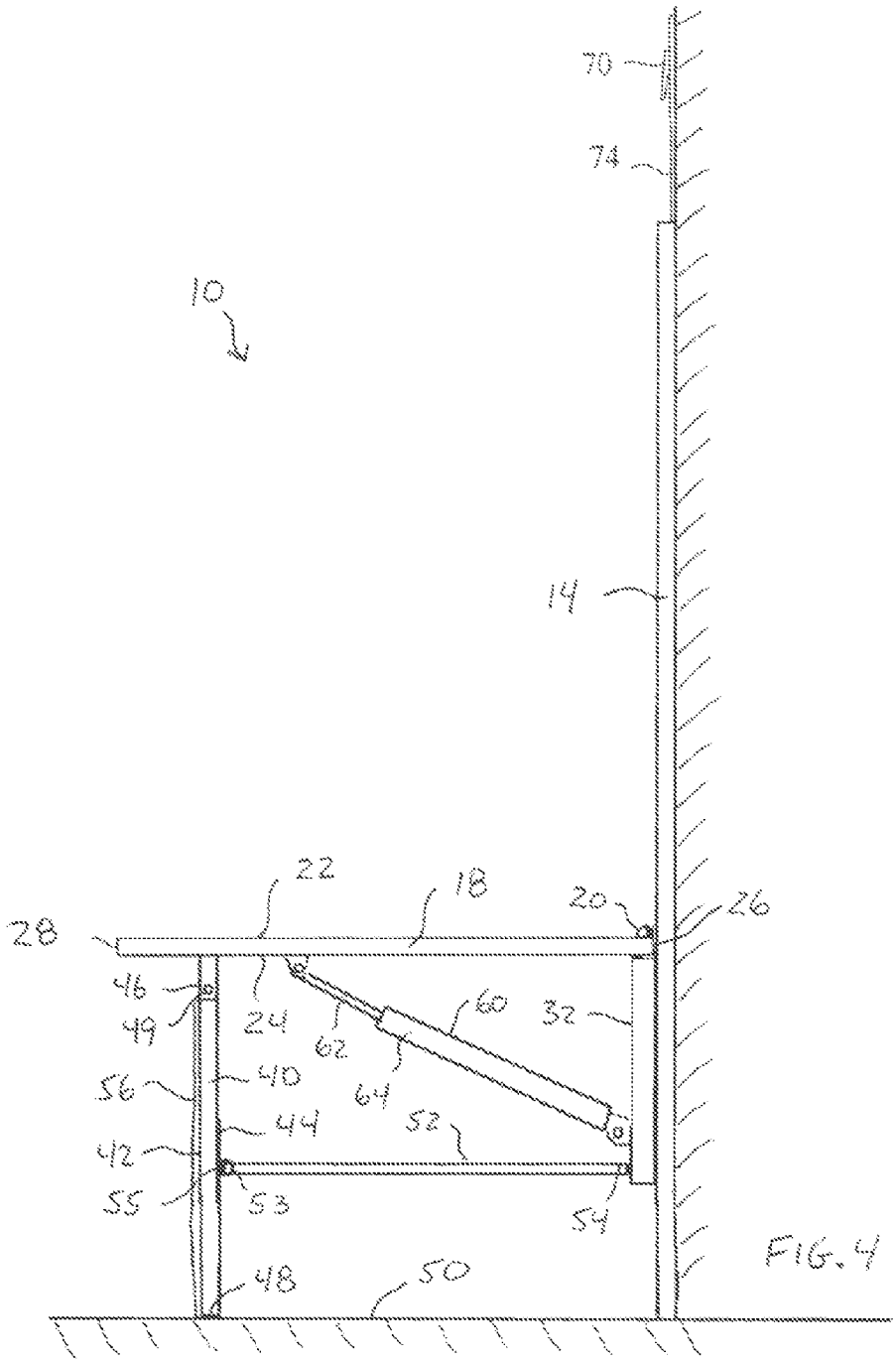
FIG. 4 is a cross-sectional view of the embodiment of FIG. 3.

Referring to FIG. 1, FIG. 2, FIG. 3 and FIG. 4, a luggage stand assembly 10 is shown in both its open, horizontal configuration (FIGS. 3 & 4) and its closed, vertical configuration (FIGS. 1 & 2). The purpose of the luggage stand assembly 10 is to provide a convenient platform in a hotel room onto which a piece of luggage 12 can be placed.

The luggage stand assembly 10 has a vertical backboard 14 that mounts to a wall 16 in a rented room, such as a hotel room. The backboard 14 is planar and attaches to the surface of the wall 16 without requiring any modifications to the wall. The backboard 14 is mounted to the wall 16 with screws or bolts, (not shown) that engage the framing studs within the wall 16.

A shelf 18 is attached to the backboard 14 with hinged connections 20. The shelf 18 has a top surface 22 and a bottom surface 24. The top surface 22 and the bottom surface 24 share a common periphery with a rear edge 26, a front edge 28 and two side edges 30. The rear edge 26 faces the backboard 14. The hinged connection 20 attaches to the shelf 18 proximate its rear edge 26. The hinged connection 20 enables the shelf 18 to be rotated in position relative the backboard 14. The shelf 18 can be selectively rotated from a closed, vertical position, shown in FIGS. 1 & 2, to an open, horizontal position, shown in FIGS. 3 & 4. When the shelf 18 is in its closed, vertical position, it lays in a plane that is generally parallel to the backboard 14. When the shelf 18 is opened to its horizontal position, the shelf 18 lays in plane that is generally perpendicular to the backboard 14.

Reinforcement elements 32 are mounted to the backboard 14 below the shelf 18. In the shown embodiment, the reinforcement elements 32 include a horizontal element 34 and two vertical elements 36. The reinforcement elements 32 are positioned to contact the bottom surface 24 of the shelf 18 when the shelf 18 is rotated into its open, horizontal position. The presence of the reinforcement elements 32 supports the shelf 18 proximate its rear edge 26. In this manner, when a heavy load is placed on the open shelf 18, the weight of the load need not be borne by the hinged connection 20. Rather, the weight of the load is transferred through the shelf 18 to the reinforcement elements 32.

The shelf 18 is expected to hold substantial amounts of weight when in its open, horizontal position. Weight toward the rear edge 26 of the shelf 18 is transferred to the reinforcement elements 32. Weight borne toward the front edge 28 of the shelf 18 is supported by two complementary support mechanisms. The primary support mechanism is a vertical support panel 40. The vertical support panel 40 has a face surface 42, a back surface 44, a top edge 46 and a bottom edge 48. The width of the vertical support panel 40 is at least as great as the distance between the vertical reinforcement elements 36 that are mounted to the backboard 14.

The top edge 46 of the vertical support panel 40 is attached to the bottom surface 24 of the shelf 18 with a hinged connection 49. As a result, gravity causes the vertical support panel 40 to rotate about that hinged connection 49 and remain in its vertical orientation as the shelf 18 moves between its open, horizontal position and its closed, vertical position. The length of the vertical support panel 40 is engineered to touch the floor 50 just as the shelf 18 is in its open, horizontal position. In this manner, the vertical support panel 40 supports the shelf 18 when it is in its open, horizontal position. The result is that any load placed on the open shelf, is transferred to the vertical support panel 40.

At least one locking linkage 52 is provided to prevent the vertical support panel 40 from being accidentally kicked inwardly or pulled outwardly while it is bearing a load. The locking linkage 52 has two ends. A first end 53 of the locking linkage 52 is connected to the back surface 44 of the vertical support panel 40 with a first hinged connection 55. The second end 54 of the locking linkage 52 is connected to the backboard 14 with a second hinged connection 55 When the shelf 18 is open to its horizontal position and the vertical support panel 40 hangs vertically and touches the floor 50, the locking linkage 52 becomes oriented horizontally between the backboard 14 and the vertical support panel 40. The locking linkage 52 therefore becomes a physical obstacle that prevents the vertical support panel 40 from being kicked inwardly or pulled outwardly away from its vertical orientation. However, the locking linkage 52 provides no resistance to the movement of the shelf 18 from its open horizontal position to its closed vertical position.

The face surface 42 of the vertical support panel 40 can be painted the same color as the wall 16. However, it is preferred that the face surface 42 of the vertical support panel 40 be decorated. For instance, the face surface 42 can be covered with a piece of fabric upholstery 56 that matches the decor of the hotel room. Alternately, the face surface 42 can be leased for commercial print ads.

In addition to the vertical support panel 40, at least one damper piston 60 is provided to help bear the load of the luggage 12. In the illustrated embodiment, two damper pistons 60 are used by way of example. The damper pistons 60 each have a shaft 62 and a barrel 64. Once the shaft 62 is fully extended from the barrel 64, the shaft 62 retracts into the barrel 64 at a controlled rate. Such damper pistons 60 are well known and are commercially available.

In the exemplary embodiment, the shaft 62 is connected to the underside of the shelf 18 near its front edge 28. The barrel 64 is mounted to the backboard 14. The barrel 64 and shaft 62 are mounted in such a manner that the shaft 62 comes to a bottom stop in the barrel 64 precisely when the shelf 18 is in its open horizontal position.

The shelf 18 is normally positioned in its closed vertical position. If a traveler wants to unpack a piece of luggage 12, the traveler pulls the shelf 18 forward. The damper pistons 60 lower the shelf 18 to its open horizontal position at a controlled rate. In this manner, the shelf 18 does not fall forward and will not cause injury. Once in its open horizontal position, the damper pistons 60 reach an internal bottom stop. The damper pistons 60 therefore act as static brackets that support the shelf 18 in its horizontal position.

Connectors 65, 66 are provided both on the shelf 18 and on the backboard 14. The connectors 65, 66 hold the shelf 18 in its closed vertical position when the assembly 10 is not in use. The connectors 65, 66 can be magnetic connectors, hook and loop connectors, or any other mechanical connector that hold the shelf 18 in its closed vertical position. A handle 68 is provided on the shelf 18. If a person pulls on the handle 68, they can open the connectors 65, 66 and the shelf 18 begins to lower to its open horizontal position.

Figure 5:
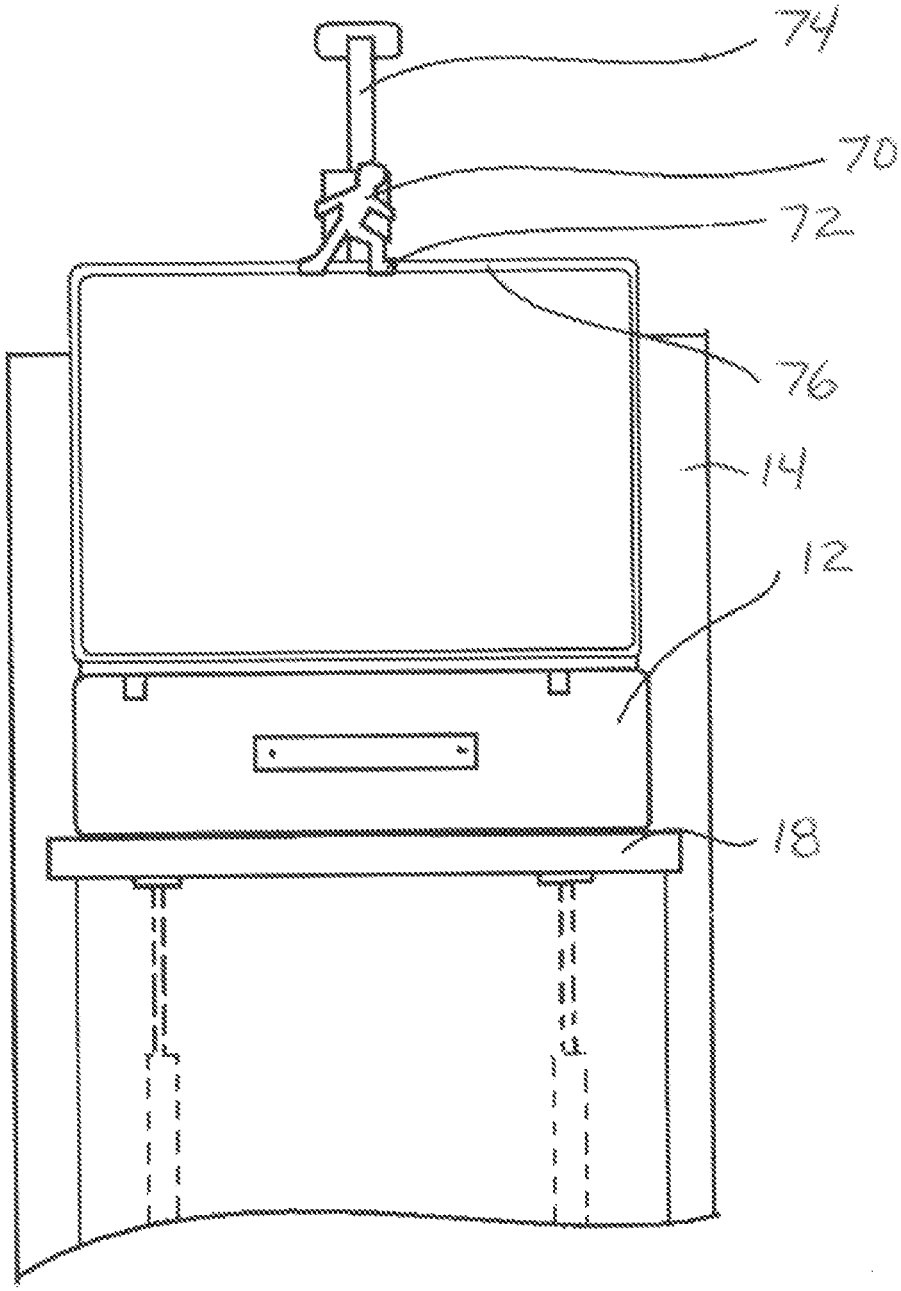
FIG. 5 is a front view of an enlarged portion of the exemplary luggage stand using a hook and slide to engage the lid of a suitcase.

Referring to FIG. 5 now in conjunction with FIGS. 1-4, it can be seen that an optional hook 70 and slide 74 can be provided that mounted to the wall 16 above the backboard 14. The hook 70 has at least one downwardly extending finger 72. The hook 70 can have many shapes. In the shown embodiment, the hook 70 is ornamental in appearance. The hook 70 is capable of moving up and down along a vertical slide 74. Enough friction exists between the hook 70 and slide 74 so that the hook 70 will remain in place anywhere along the slide 74 if released in that position.

Referring to FIG. 1 through FIG. 5 in combination, the function of the luggage stand assembly 10 can be understood. The luggage stand assembly 10 is mounted to the wall 16 in a rented room. The shelf 18 is initially stored in its closed vertical position. When a patron rents the room and wants to load or unload luggage 12, the patron pulls the shelf 18 open. The shelf 18 slowly moves to its open horizontal position, guided by the damper pistons 60. The shelf 18 comes to rest in its open horizontal position. The luggage 12 is then placed atop the shelf 18. The lid 76 of the luggage 12 is unzipped and raised. The hook 70 is moved along the slide 74 to engage the open lid 76. The hook 70 therefore holds the lid 76 of the luggage 76 open as it is packed or unpacked.

It will be understood that the embodiment of the present invention that is illustrated and described is merely exemplary and that a person skilled in the art can make many variations to that embodiment. All such alternate embodiments are intended to be included within the scope of the present invention as claimed.

What is claimed is:

1. A wall mounted stand assembly comprising:

a backboard;

a vertical slide supported by said backboard, wherein said vertical slide has a first length;

a hook that engages said vertical slide, wherein said hook is selectively moveable up and down along said first length of said vertical slide;

a shelf having a bottom surface and a rear edge, wherein said shelf is connected to said backboard with a hinged connection proximate said rear edge, therein enabling said shelf to rotate between a vertical orientation, where said shelf is generally parallel to said backboard, and a horizontal orientation where said shelf is generally perpendicular to said backboard;

at least one damper piston having a first end coupled to said backboard and a second end coupled to said bottom surface of said shelf, wherein said damper piston retards the movement of said shelf from said vertical orientation to said horizontal orientation.

2. The assembly according to claim 1, further including a vertical support panel connected to said bottom surface of said shelf with a second hinged connection, wherein said vertical support panel supports said shelf when said shelf is in said horizontal orientation.

3. The assembly according to claim 2, further including a locking linkage extending between said vertical support panel and said backboard, wherein said locking linkage prevents said vertical support panel being inadvertently forced out of a vertical orientation when said shelf is in said horizontal orientation.

4. The assembly according to claim 1, further including a connector disposed between said shelf and said backboard for temporarily holding said shelf in said vertical orientation when said assembly is not in use.

5. The assembly according to claim 1, further including at least one reinforcement element connected to said backboard that engages and supports said shelf proximate said rear edge of said shelf when said shelf is in said horizontal orientation.

6. The assembly according to claim 1, wherein said at least one damper piston comes to a bottom stop when said shelf is in said horizontal orientation.

7. The assembly according to claim 1, wherein said vertical support panel has an exterior surface covered by fabric.

8. The assembly according to claim 1, further including a handle affixed to said bottom surface of said shelf.

9. A wall mounted stand assembly comprising:

a backboard;

a shelf having a bottom surface and a rear edge, wherein said shelf is connected to said backboard with a hinged connection proximate said rear edge, therein enabling said shelf to rotate between a vertical orientation, where said shelf is generally parallel to said backboard, and a horizontal orientation where said shelf is generally perpendicular to said backboard;

a vertical support panel connected to said bottom surface of said shelf with a second hinged connection, wherein said vertical support panel supports said shelf when said shelf is in said horizontal orientation;

at least one damper piston that retards the movement of said shelf from said vertical orientation to said horizontal orientation and a locking linkage extending between said vertical support panel and said backboard, wherein said locking linkage extends completely horizontally and prevents said vertical support panel from being inadvertently forced out of a vertical orientation when said shelf is in said horizontal orientation, wherein said at least one damper piston and said locking linkage remain fully hidden behind said vertical support panel both when said shelf is in said horizontal orientation and when said shelf is in said vertical orientation.

10. The assembly according to claim 9, further including a connector disposed between said shelf and said backboard for temporarily holding said shelf in said closed orientation when said assembly is not in use.

11. The assembly according to claim 9, further including at least one reinforcement element connected to said backboard that engages and supports said shelf proximate said rear edge of said shelf when said shelf is in said horizontal orientation.

12. The assembly according to claim 9, wherein said at least one damper piston comes to a bottom stop when said shelf is in said horizontal orientation.

13. The assembly according to claim 9, wherein said vertical support panel has an exterior surface covered by fabric.

14. The assembly according to claim 9, further including a hook coupled to said backboard above said shelf, wherein said hook is electively vertically moveable along said backboard throughout a predetermined range.

15. The assembly according to claim 14, wherein said hook rides along a vertical slide that is affixed to said backboard.

16. The assembly according to claim 9, further including a handle affixed to said bottom surface of said shelf.

* * * * *